United States Patent [19]

Bouplon

[11] 4,262,966

[45] Apr. 21, 1981

[54] ROAD SURFACE REMOVING MACHINE

[75] Inventor: Edward J. Bouplon, Streetsboro, Ohio

[73] Assignee: Allied Steel & Tractor Products, Inc., Solon, Ohio

[21] Appl. No.: 33,180

[22] Filed: Apr. 25, 1979

[51] Int. Cl.[3] ..... E01C 23/09

[52] U.S. Cl. ..... 299/39; 299/85; 299/37

[58] Field of Search ..... 299/39–41, 299/37; 404/90, 91; 51/176

[56] References Cited

U.S. PATENT DOCUMENTS

| | | | |
|---|---|---|---|
| 800,962 | 10/1905 | Wattles | 51/176 |
| 1,812,771 | 6/1931 | Blood et al. | 299/41 |
| 3,572,842 | 3/1971 | Mori | 299/39 |
| 3,695,722 | 10/1972 | Fairweather et al. | 299/85 X |
| 3,779,606 | 12/1973 | Hatcher et al. | 299/39 |
| 3,868,146 | 2/1975 | Ellis | 299/39 |
| 3,896,989 | 7/1975 | Ellis | 299/39 |
| 3,904,245 | 9/1975 | Clarke | 299/37 |

*Primary Examiner*—Ernest R. Purser
*Attorney, Agent, or Firm*—Stephen J. Rudy

[57] ABSTRACT

A road surface removing machine including a modular assemblage, having a rotary cutter drum unit with flailing arms adapted to impact upon a road surface for disintegration of the surface, said drum unit having four degrees of movement, boom means associated with a rail means assemblage for operative movement of the cutter drum, outrigger means for stabilizing the machine, a vacuum operated system for picking up disintegrated road surface debris and depositing it in a separation bin, and an hydraulic circuitry for operation of the components of the machine.

4 Claims, 20 Drawing Figures

Fig. 11.
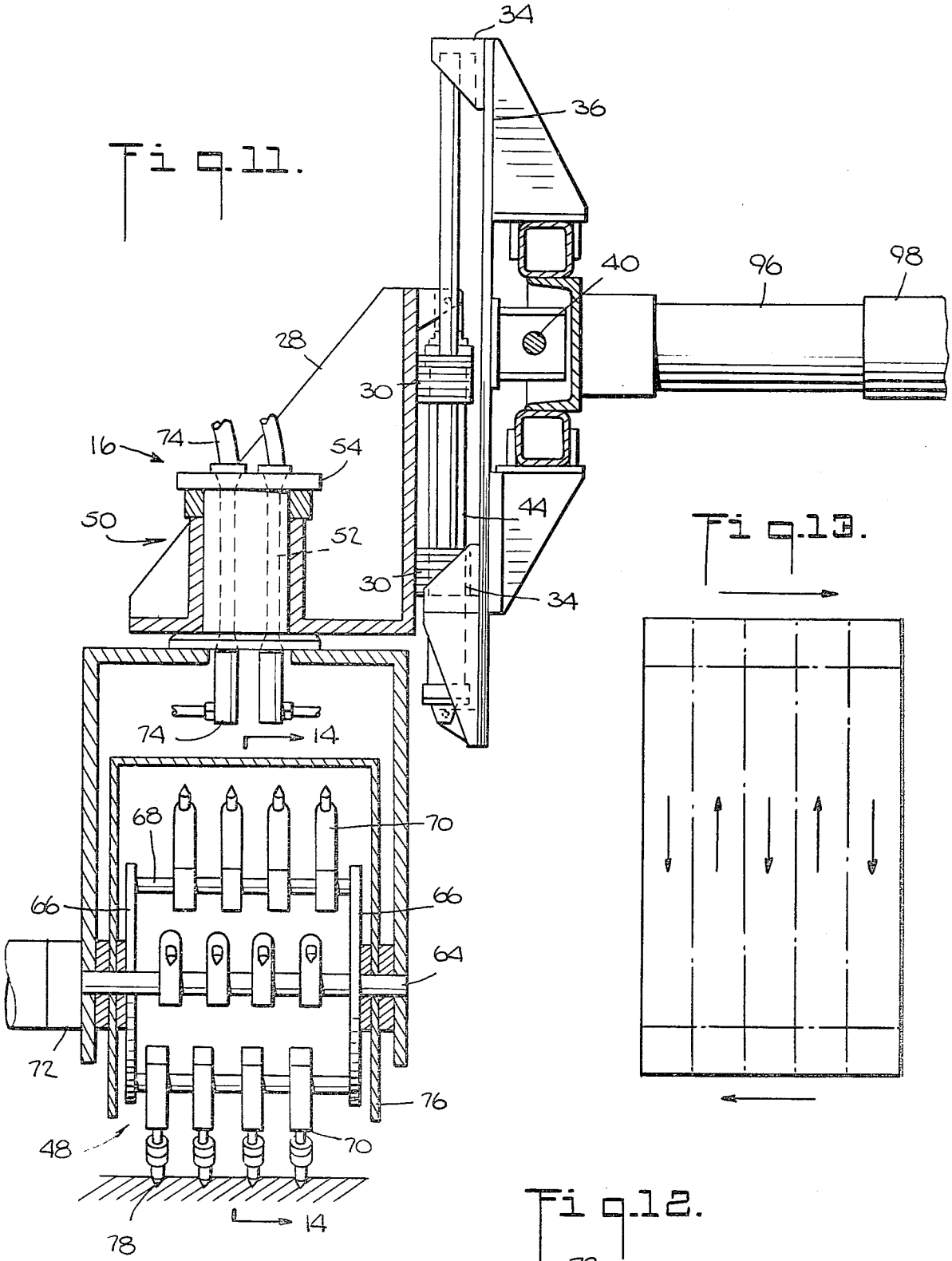
Fig. 13.
Fig. 12.
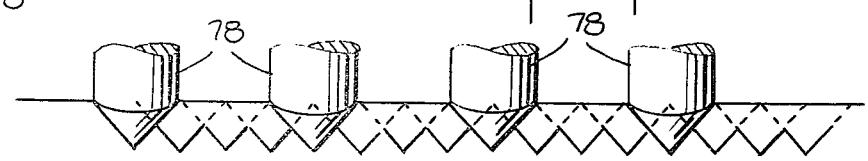

ROAD SURFACE REMOVING MACHINE

BACKGROUND OF THE INVENTION

This invention relates to a road surface removing machine.

Such machines of the prior art utilize differing types of action to achieve desired road surface removing results, e.g., impacting, milling, sawing, and heat with ripping as used on asphalt road surfaces.

The machine of the invention relies upon impacting to disintegrate the road surface material being worked upon, however, it operates in a manner which provides results and advantages not associated with known prior art road surface removing machines.

Among the improved results the machine of the invention provides is the ability to form vertical edges around the entire cavity area of road surface being removed thereby avoiding feather-edging of new material applied to fill the cavity. This results in a stronger and more serviceable road surface refill. Machines of the prior art which utilize rotary, or drum cutters, leave a tapered edge at the beginning and ending of the cutting action.

Another advantage the machine of the invention provides is that the operator has better control of the surface cutting operation since the machine is maintained stationary during operation, while the cutter means is movable and under his control, hence, the operator can devote his full attention to the cutting operation with attendant advantages. In comparable machines of the prior art, the machine moves and the cutting means is carried along therewith, hence, the operator must be attentive to machine guidance which diminishes the attention he can devote to actual cutting operations.

A further advantage of the machine of the invention is that it can be arranged on a standard automotive truck thereby minimizing assemblage costs and at the same time providing a road surface removing machine that can traverse the highways at normal vehicle speed when going to or from a work area.

Still another advantage the machine of the invention provides is a vacuum debris pick-up means, which, coupled with an efficient collection means, removes and disposes road surface debris generated in an effective manner.

The use of specially designed flail arms mounted on a rotary drum, together with truck stabilizing means, provides reduced vibration action whereby depth of cut can be readily maintained.

These and further features and advantages the machine of the invention will satisfy the basic objective, namely, to provide an efficient road surface removal operation.

BRIEF DESCRIPTION OF THE DRAWINGS

In the accompanying drawings:

FIG. 3 is a partial view of the machine of FIG. 1, showing certain parts in operative mode;

FIG. 11 is an elevation view illustrating the cutter assembly of FIG. 5 in operative mode;

FIG. 12 is a view illustrating a cutting pattern produced on a road surface by the cutter assembly of FIG. 5;

FIG. 13 is a schematic view of a road surface illustrating a cutting pattern produced with the cutter assembly of FIG. 5;

It will be noted that the scale used in the various Figs. is not uniform, each scale being selected to best illustrate the material being shown.

DESCRIPTION OF PREFERRED EMBODIMENT

Figure 1:
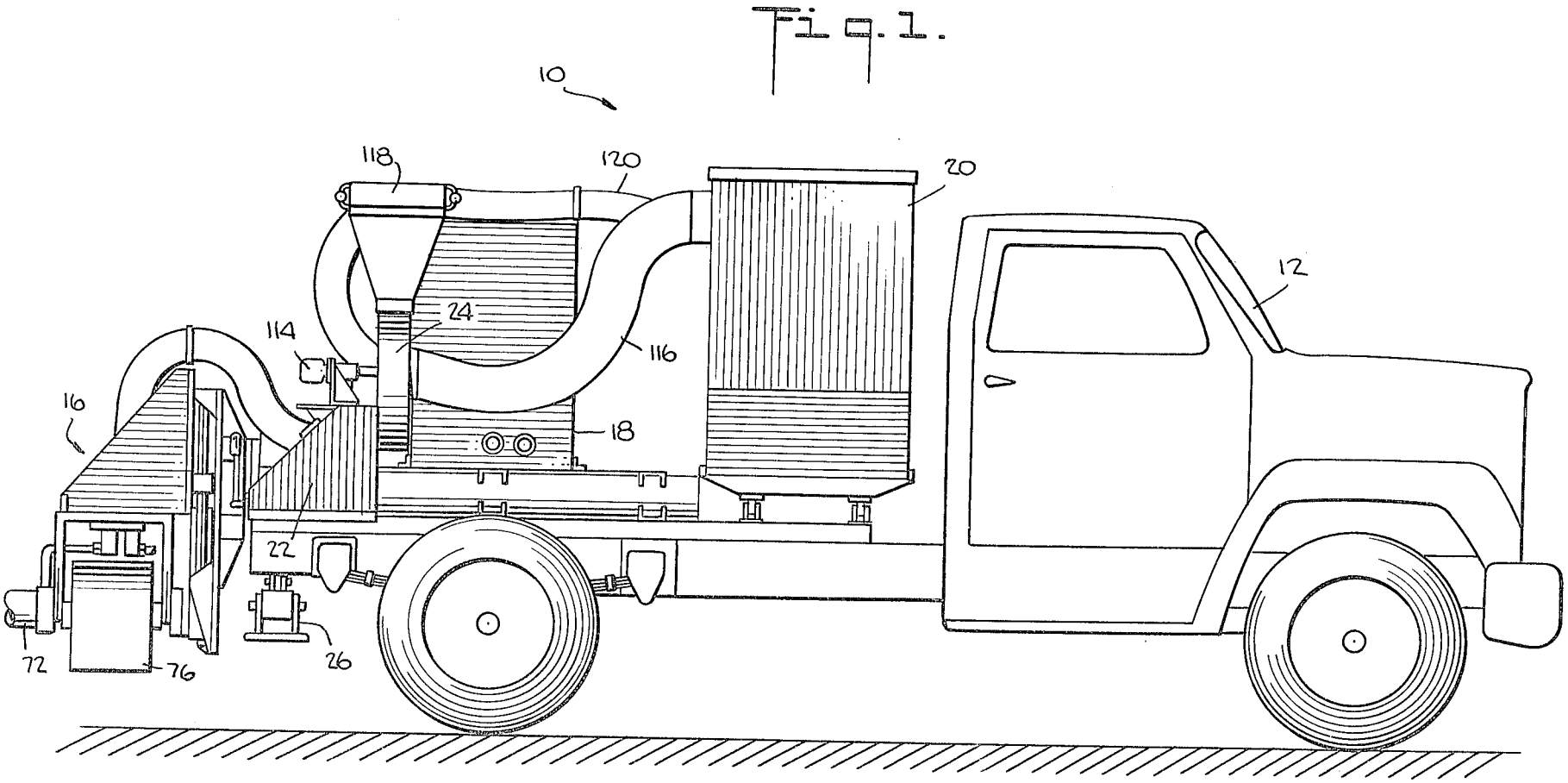
FIG. 1 is a side elevational view of a road surface removing machine embodying the invention.

Referring now to FIG. 1, numeral 10 identifies a road surface removing machine embodying the principles of the invention, which machine includes a motor vehicle 12 of the truck type on which is mounted a modular assemblage 14, the latter incorporating a combination of elements arranged to provide a road surface removal operation in keeping with the basic objective of the invention.

The modular assemblage 14, includes a cutter drum unit 16, a hydraulic reservoir 18, a spoil or separation bin 20, a control console 22, a blower 24, and an outrigger means 26.

The motor vehicle 12 is preferably a medium duty truck, such as the Chevrolet "C-50", which is stripped down, to provide only the truck cab and chassis. The modular assembly 14 is mounted upon the frame, as best seen in FIG. 1. If desired, the modular assembly may be arranged for easy removal from the frame, so that other load carrying means, such as would modify the vehicle for dump truck service until the modular assembly arrangement is again needed.

The operational arrangement of the cutter drum unit 16, best seen in FIGS. 5–10, includes a truncated box-like housing 28, the rear side of which has two sets of lugs 30 arranged to slide upon a pair of parallel and vertically arranged rods 32. The ends of the rods are secured to lugs 34 affixed to a plate member 36 slidably mounted upon a horizontal rail means assemblage 38. A screw shaft 40 mounted at each end in the assemblage 38, is threadably coupled to the plate member 36, and a drive motor 42 is arranged at one end of the shaft (FIG. 10) to rotate the screw shaft in either direction, thereby causing lateral movement of the cutter drum unit 16. A piston means 44 is arranged to provide vertical movement of the housing 28 upon the rods 32.

Figure 9:
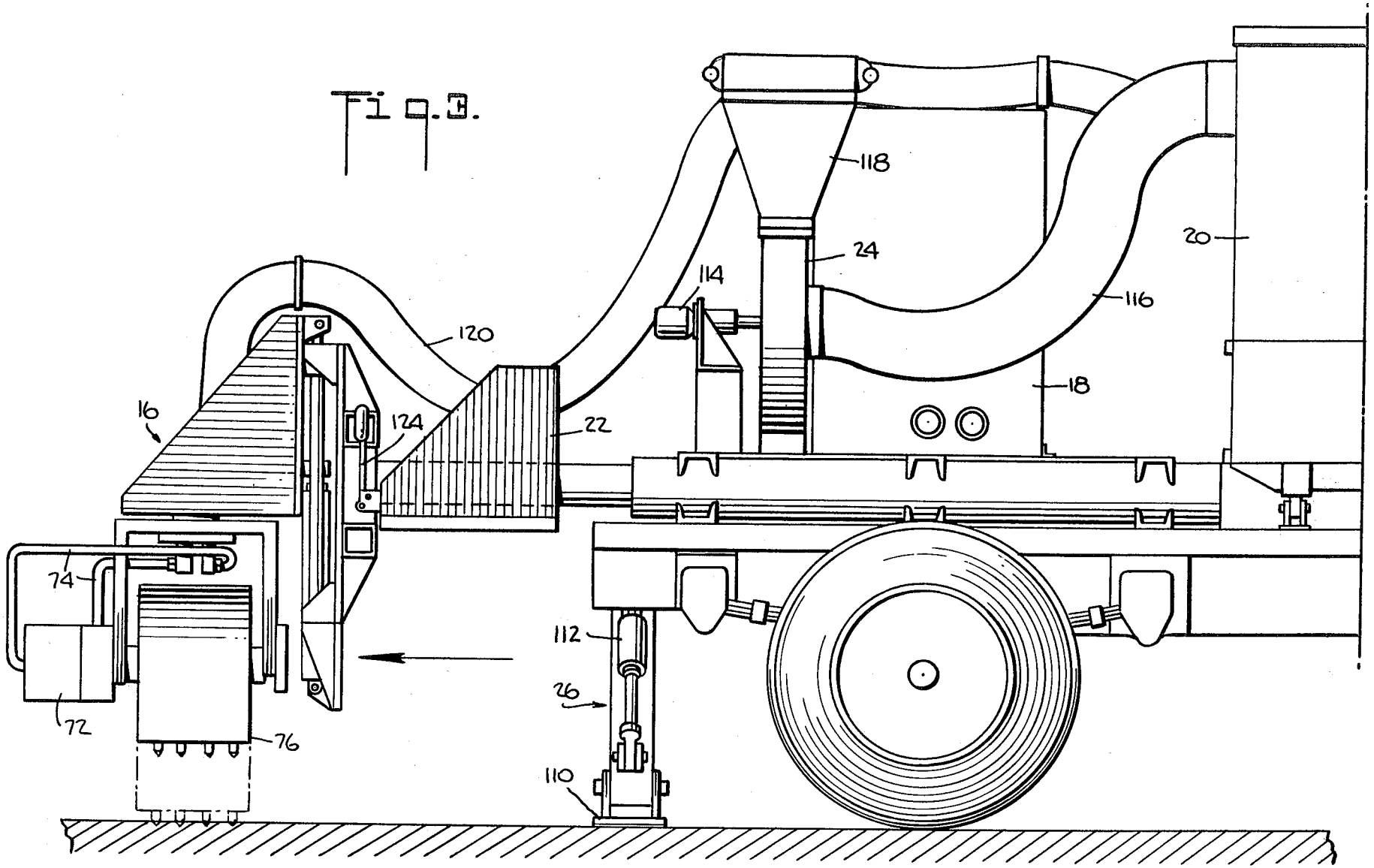
FIG. 9 is the same as FIG. 8, but showing a second operative position.
Figure 8:
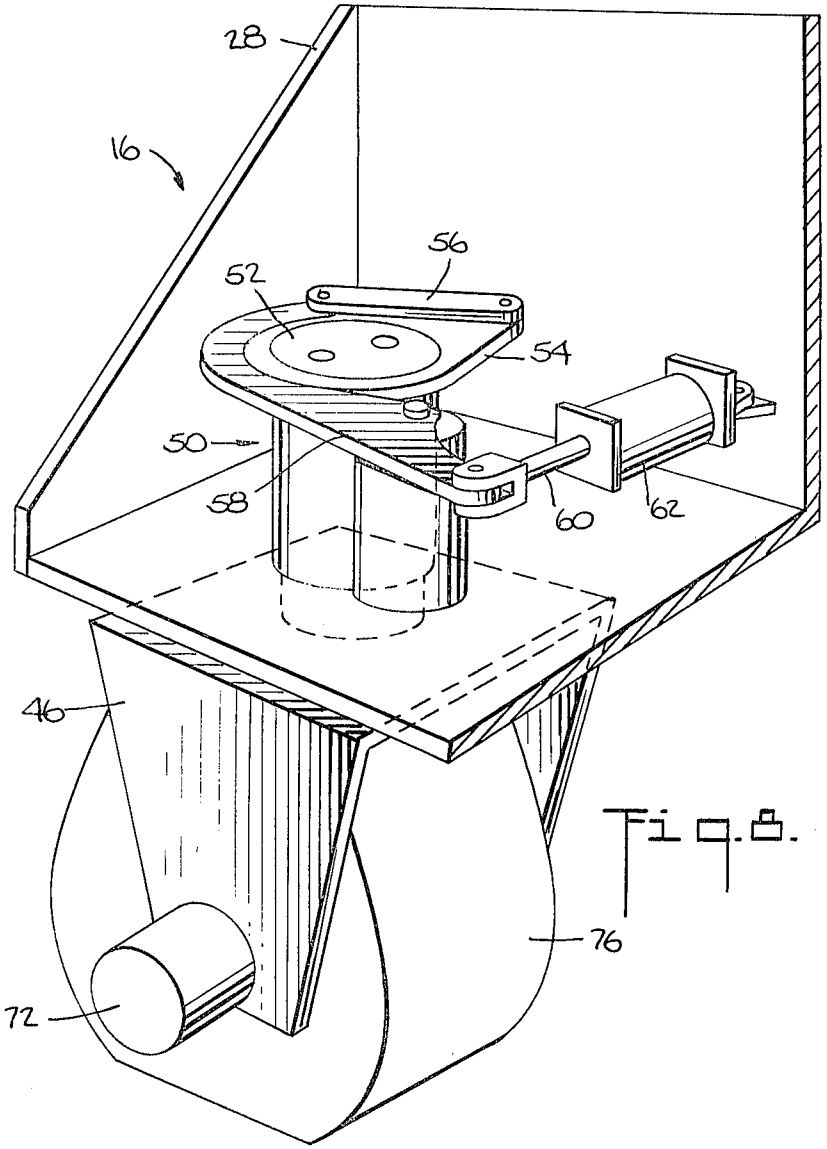
FIG. 8 is a perspective view of a position control means for the cutter assembly of FIG. 5, showing one operative position.

Rotatably affixed to the bottom of the housing 28, is a U-shaped bracket 46 which supports a cutter drum assemblage 48. The bracket 46 is rotatable through an arc of 90° by a rotation means 50, which includes a cylinder 52, the lower end of which is affixed to the bracket 46, a plate 54 affixed to the upper end of the cylinder 52, linkage means including an arm 56 connected to the plate 54, a pivotal arm 58, one end of the latter being connected to the arm 56, another end thereof being connected to a piston rod 60 extending from a drive cylinder 62, all as best seen in FIGS. 8 and 9.

The cutter drum assemblage 48 includes a main shaft 64 rotatably mounted in the bracket 46, side plates 66 affixed to the shaft 64, four equally spaced cutter arm shafts 68 secured to the side plates 66, and four cutter arms or flails 70 rotatably supported on each shaft 68 for 360° rotation. The four cutter arms of any given set are equally spaced laterally from each other, and each set of cutter arms is staggered to provide a cutting pattern substantially coextensive with the width between the side plates 66, as best seen in FIG. 12. A motor 72 affixed to one leg of the bracket 46, is operative to rotate the drum assemblage 48. Hose means 74 is arranged to supply motive fluid to the motor 72. A shroud 76, secured within the bracket 46, encloses all of the drum assemblage 48, except for an opening at the lower end, the edges of which are arranged in parallel relation to a road surface being worked upon, and from which the ends of the cutter arms 70 of any given set project for impacting with the road surface.

Figure 18:
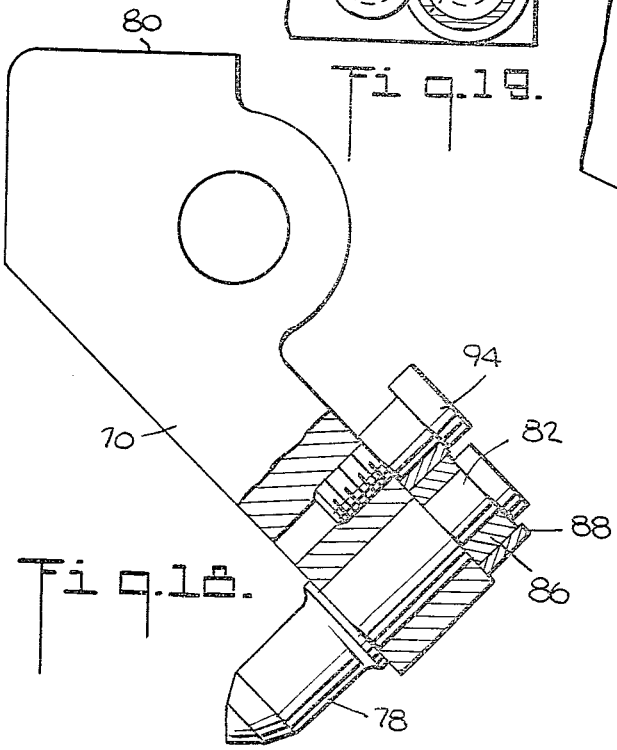
FIG. 18 is a view in partial section of another form of cutter element arrangement used in the cutter assembly of the invention.

Each cutter arm 70 has a rotationally mounted conical bit 78 of tungsten carbide or equivalent, arranged at one end, the opposite end of the arm having an enlarged portion 80, as best seen in FIG. 18. The reason for the unusual configuration of the arm is to make the center of percussion occur at the bit tip, to thus minimize bearing reaction and prolong bearing and shaft life. In addition, the center-line of each bit in a given set is canted at an angle of 5° relative to the longitudinal plane of the cutter arm, however, the bits closest to each side plate 66 are canted at an angle of 12° in the direction of the end plates. Such canting has the effect of automatically rotating the bit during operation so that the tip thereof will be uniformly worn.

Figure 15:
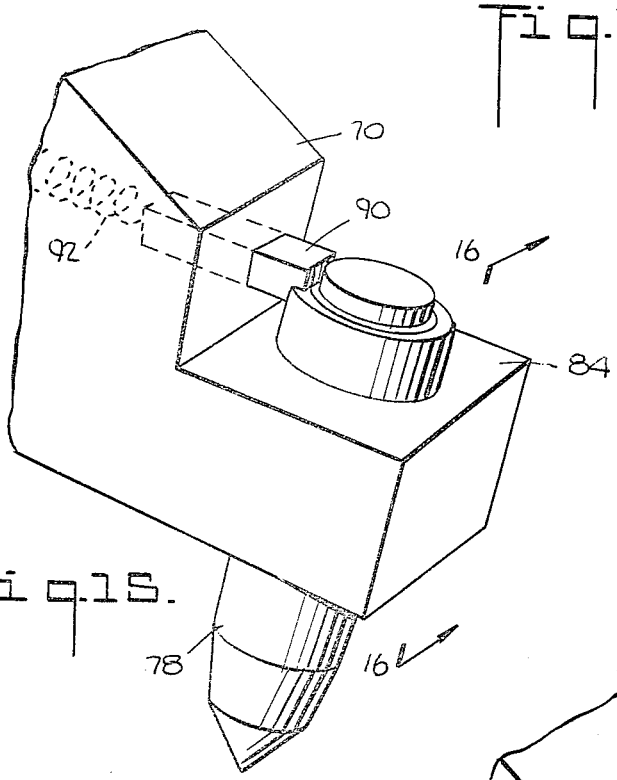
FIG. 15 is a perspective view of an end of a cutter element used in the cutter assembly of FIG. 5.
Figure 16:
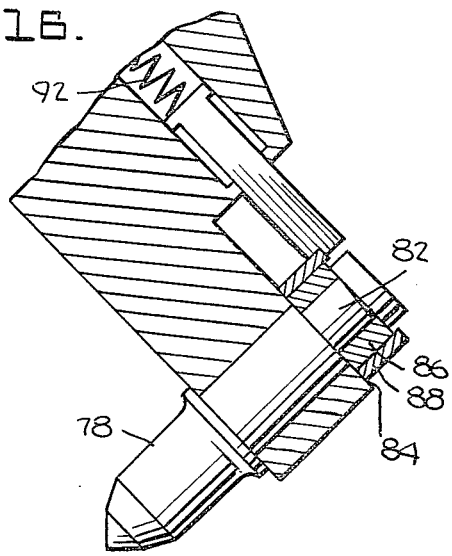
FIG. 16 is a section view generally as seen from line 16—16 in FIG. 15.
Figure 17:
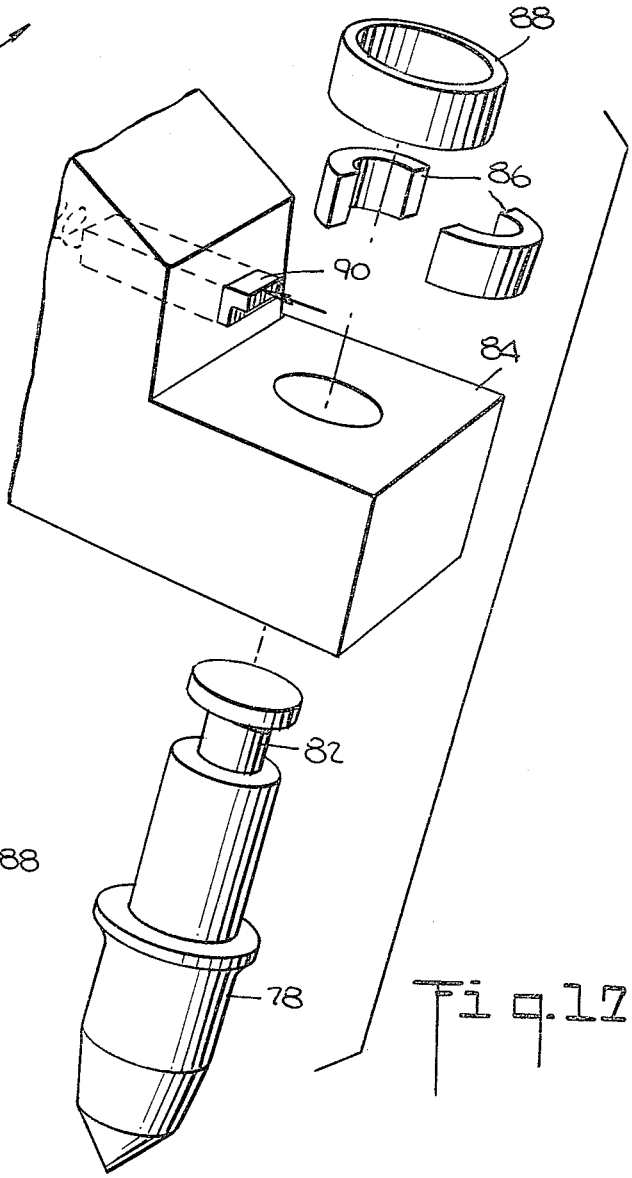
FIG. 17 is an exploded view showing in greater detail the elements in the FIG. 15 illustration.

Each bit 78 is mounted in the arm 70 in a manner which will assure positive locking in position, while easy removal is afforded for bit replacement. Toward this end, the bit has a circumferential recess 82 in the end which projects above a flat surface 84 formed in the arm. A pair of split collars 86 is arranged to fit within the recess 82 and the collars 86 are maintained therein by a collar 88. The collar 88 is maintained in position by means of a rectangular arm 90 which is slidably arranged in the arm, and is urged into holding engagement with the collar by a compression spring 92, all as best seen in FIGS. 15–17.

Figure 19:
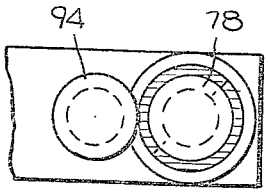
FIG. 19 is a top view of a portion of the cutter element of FIG. 18.

A slightly modified collar holding arrangement is illustrated in FIGS. 18–19. Instead of a spring loaded arm as in the arrangement just described, the holding means comprises a cap screw 94, which is threadably secured to the arm so that the head of the cap screw abuts the upper edge of the collar 88.

The rail means assemblage 38 is affixed to the ends of a boom comprising two parallel cylindrical members 96, which are slidably arranged in tube means 98, supported upon the body frame of the motor vehicle 12. The end of a piston 100, slidable in a cylinder 102, positioned midway between the tube means 98, is connected to the assemblage 38. Axial movement of the piston 100 results in movement of the assemblage 38 toward the vehicle chassis or away therefrom, with similar movement of the cutter drum assemblage 48 (FIG. 3).

Figure 7:
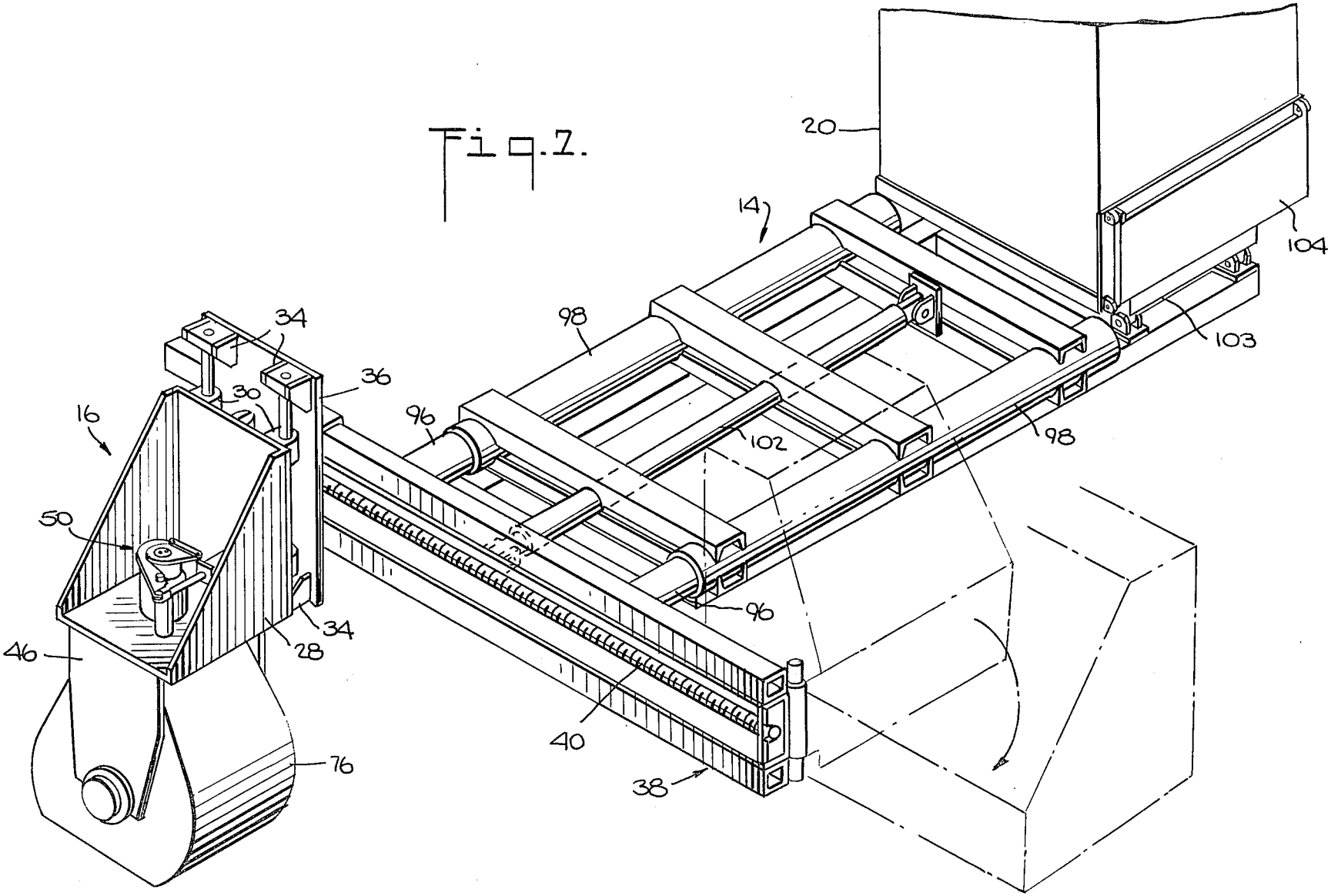
FIG. 7 is a perspective view of a mounting arrangement for the cutter assembly of FIG. 5.
Figure 9:
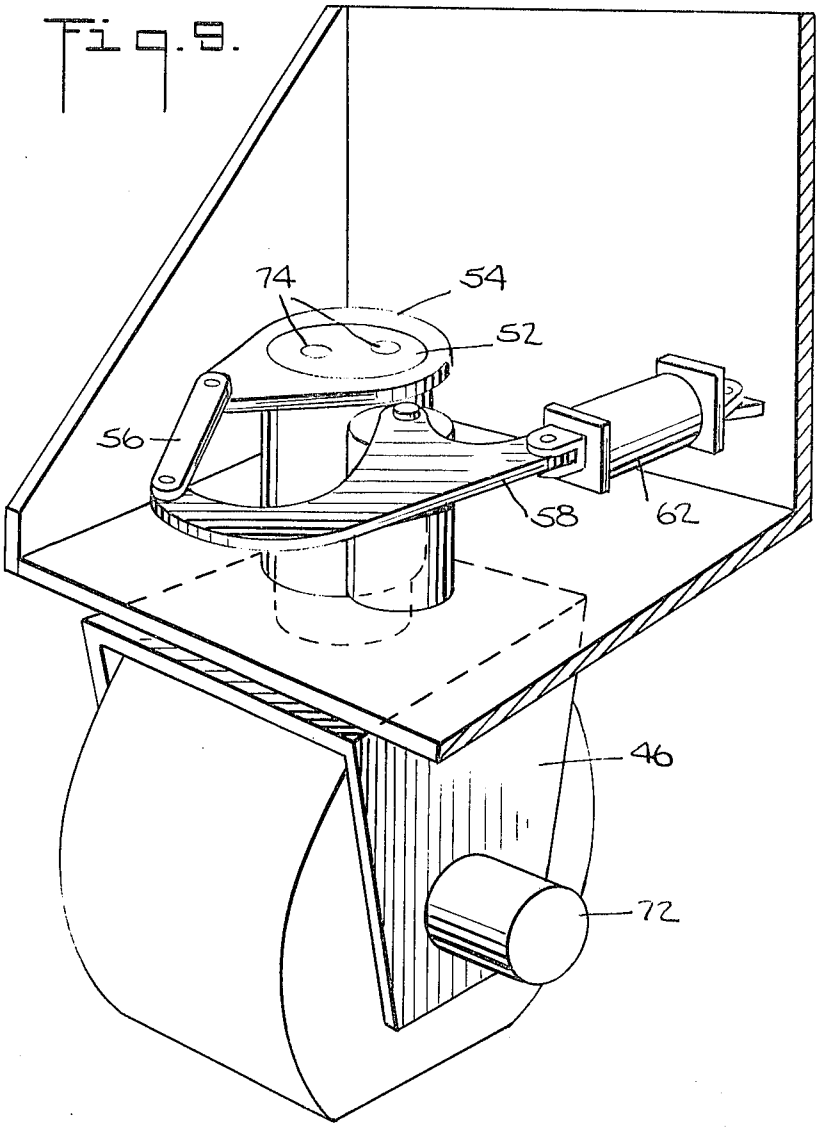

The separator bin 20 is positioned on the chassis at the rear end of the cylinders 102, and is arranged for pivotal movement about an axis 103, substantially in alignment with the axis of one of the cylinders 102, as best seen in FIG. 7. A trap door 104 is hinged to the bin 20 at the lower portion adjacent the axis 103 whereby debris will flow from the bin when it is tilted about the axis 103. A cylinder means (not shown) is arranged for tilting movement of the bin.

Figure 4:
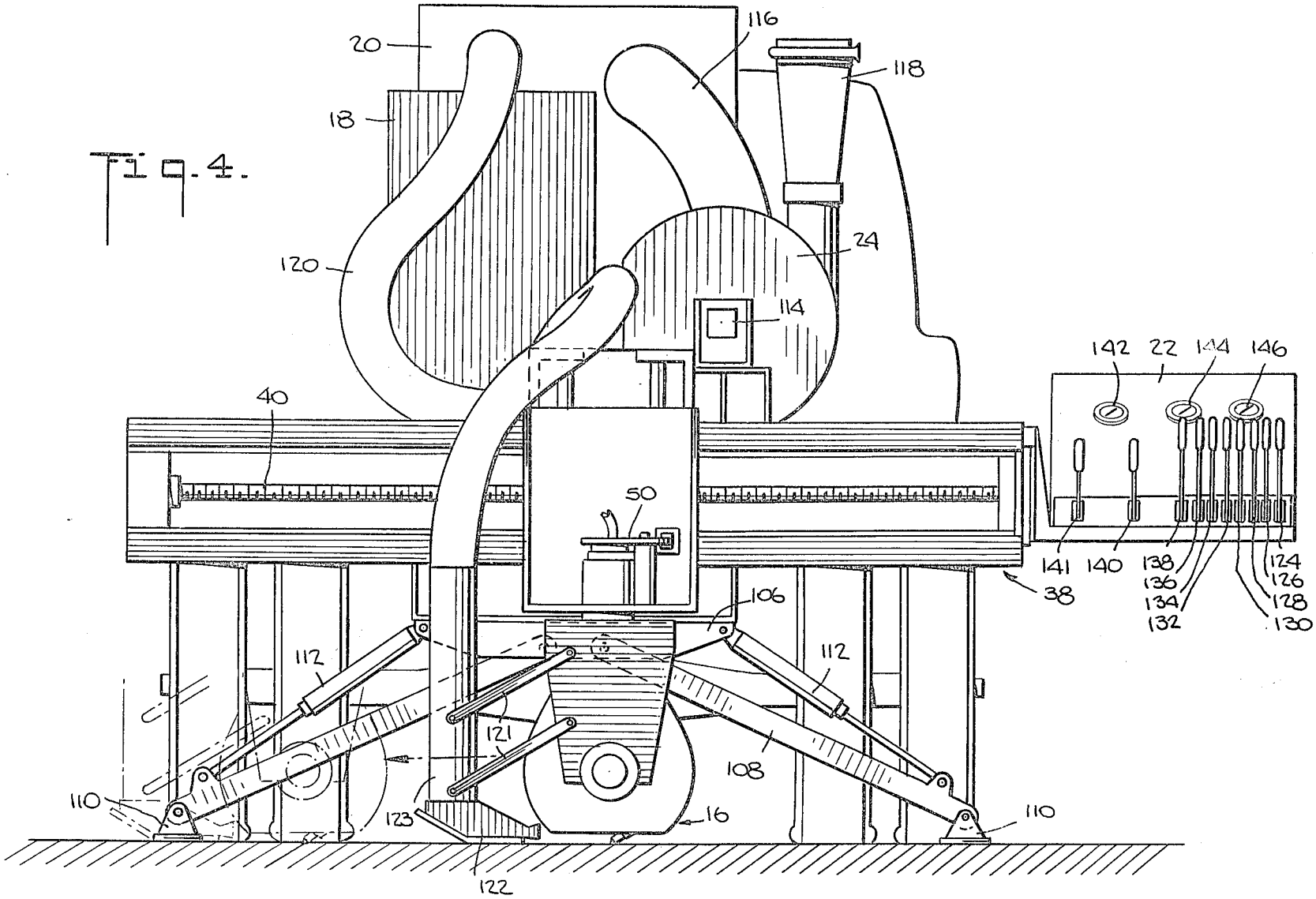
FIG. 4 is an end view of FIG. 3.
Figure 6:
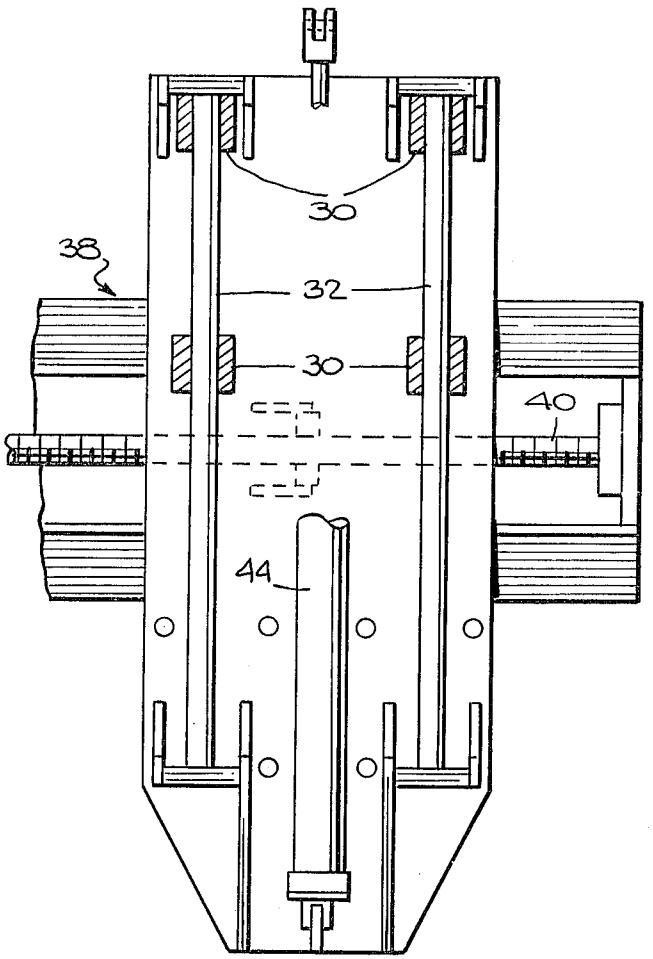
FIG. 6 is a view generally as seen from line 6—6 in FIG. 5.
Figure 5:
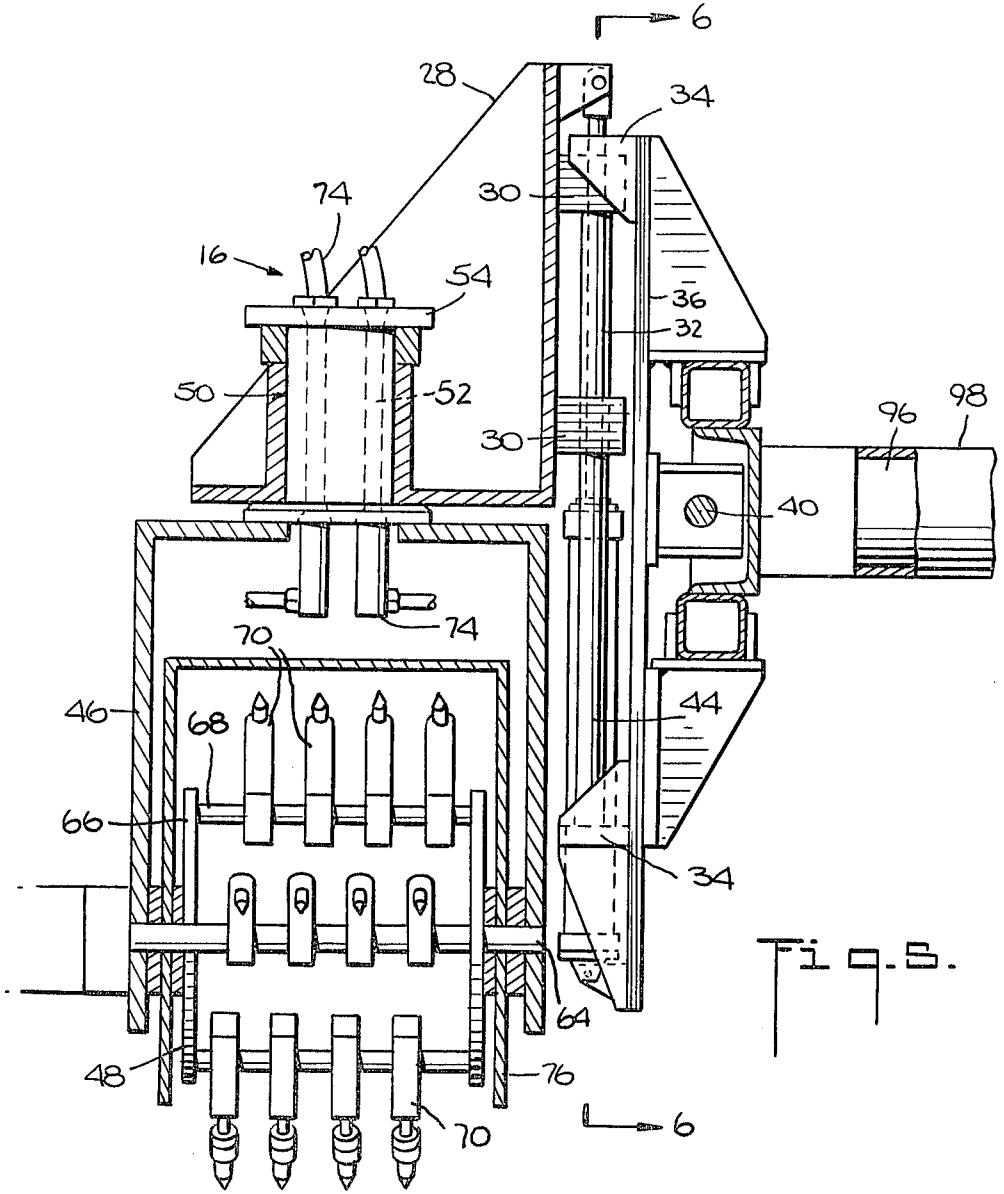
FIG. 5 is a view of a cutter assembly used in a machine of the invention.

The outrigger means 26, includes a bracket 106 secured underneath the end of the chassis frame, and a pair of arms 108 pivotally affixed to the bracket 106 at one end, each arm having at the far end a pad member 110 pivotally affixed thereto. A piston and cylinder unit 112 is arranged between the bracket 106 and the outer end of each arm 108, so that the arms can be maintained in horizontal non-operative position (FIG. 2), or in position whereby the pad members 110 are maintained in engagement with the ground surface (FIG. 4). The outrigger means 26 is utilized to stabilize the vehicle during road surface removal operations.

Figure 14:
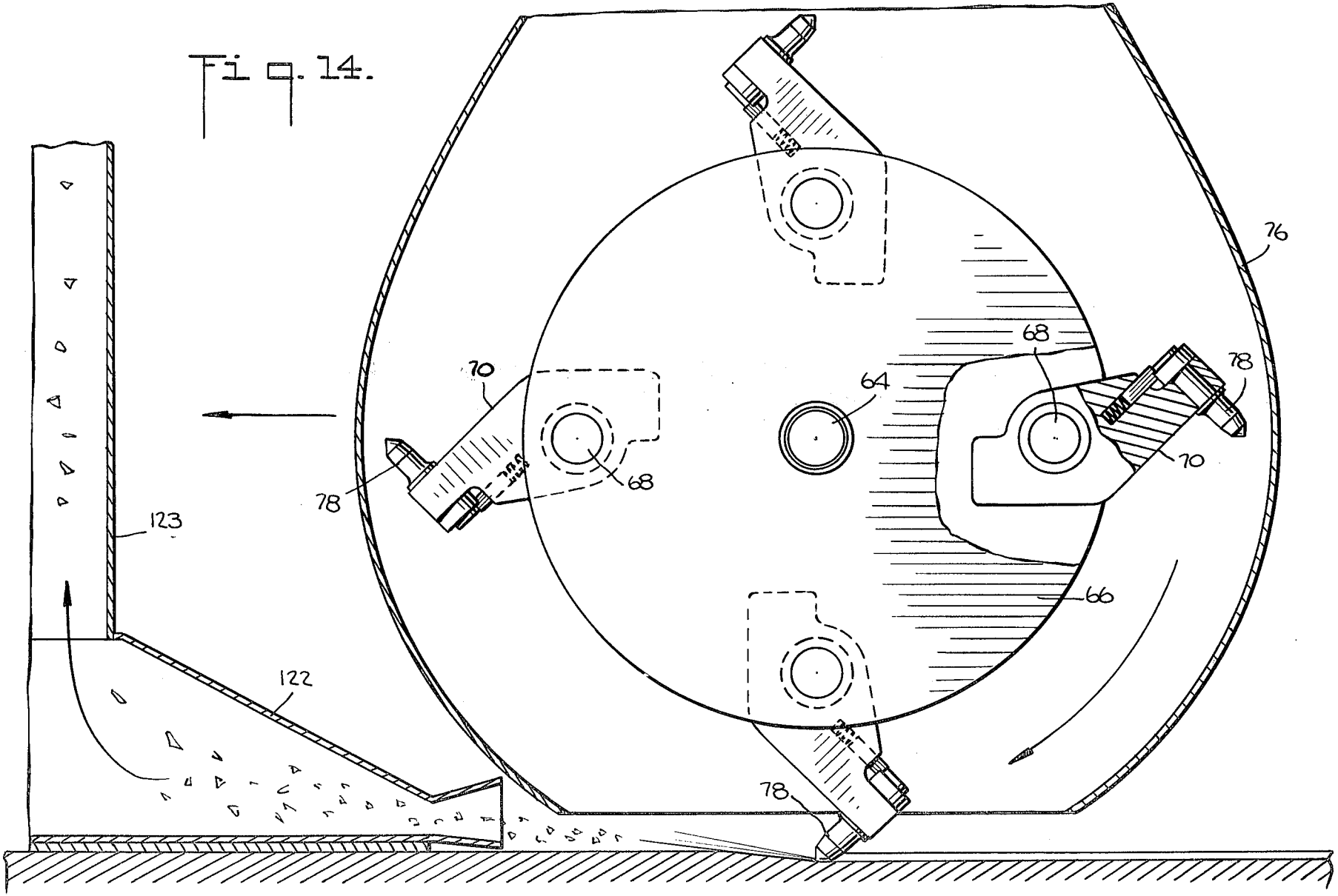
FIG. 14 is a view generally as seen from line 14—14 in FIG. 11.

The blower 24 is affixed to the chassis frame as best seen in FIG. 1, and is driven by a motor 114 to provide suction for pickup of debris removed by action of the cutter drum assemblage. The blower draws air from the bin 20 via a hose 116, which air is then expelled to atmosphere as it passes through a heat exchanger unit 118 mounted atop the blower. Reduced pressure in the bin 20 generates a suction effect in a hose 120, one end of which connects with the bin 20 at the upper end, the other end having a pickup nozzle assemblage 122 positioned in close proximity to the opening in the lower end of the shroud 76 (FIG. 14). Two pairs of paralled arms 121, are pivotally arranged between the bracket 46 and a sleeve 123 on the end of hose 120, for guided vertical movement of the nozzle 122. An intake velocity at the nozzle of 200 ft. /sec. has been found to be satisfactory. The debris thus picked up and delivered to the bin via the hose 120, falls to the bottom of the bin.

Figure 20:
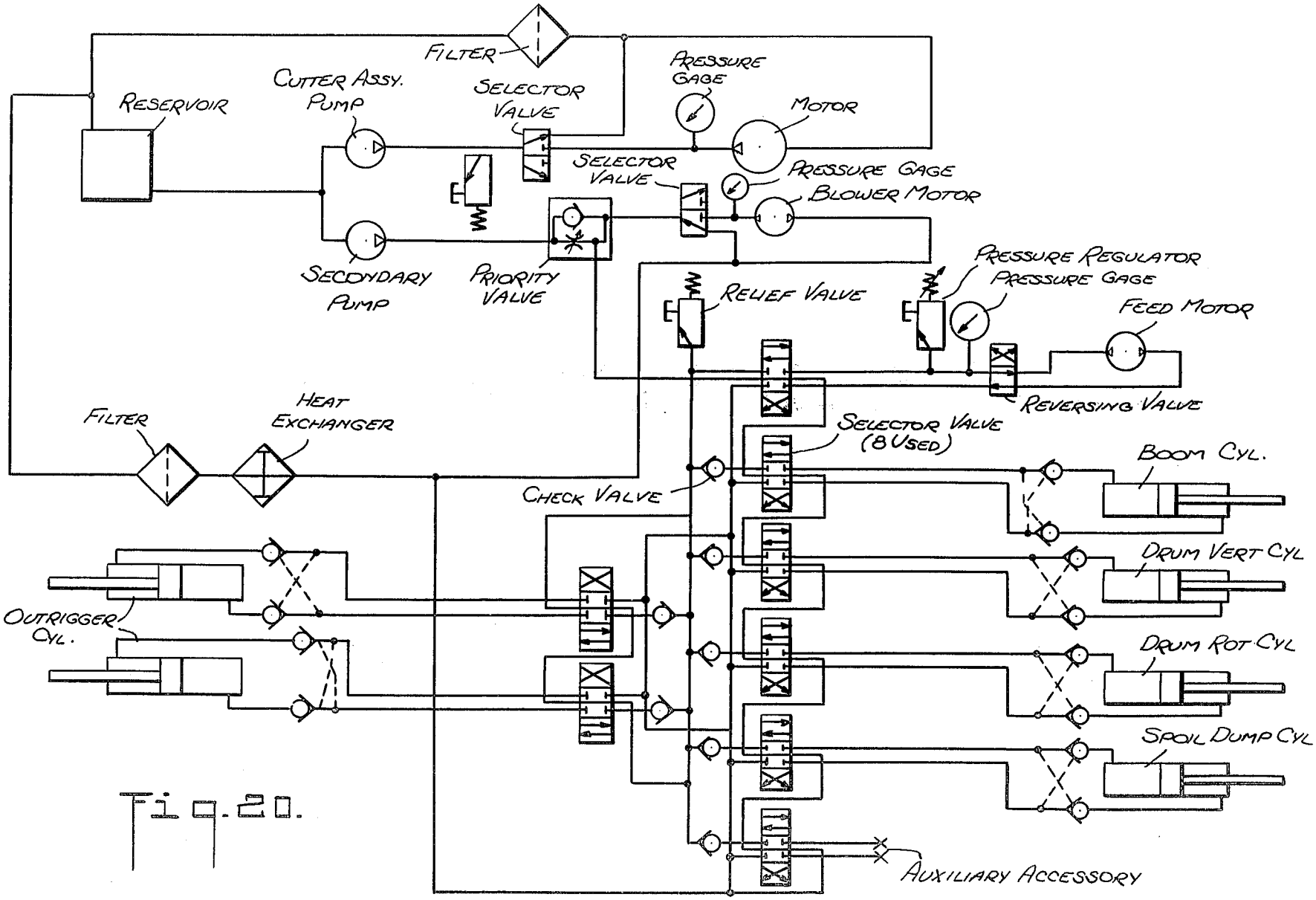
FIG. 20 is a schematic view of operative circuits employed in the machine of the invention.

The hydraulic reservoir 18 is mounted atop the vehicle chassis frame, and contains a quantity of hydraulic fluid, e.g. oil, for use in the power circuits of the various operative elements as schematically depicted in FIG. 20. The heat exchanger unit 118, functions to cool the oil being returned to the reservoir. In the circuits illustrated in FIG. 20, the various elements are labeled so that the functional aspects thereof will be self-evident. The two pumps depicted are arranged to be coupled to a power take-off (not shown) of the vehicle engine; in the alternative, a separate prime mover may be employed if desired.

Figure 2:
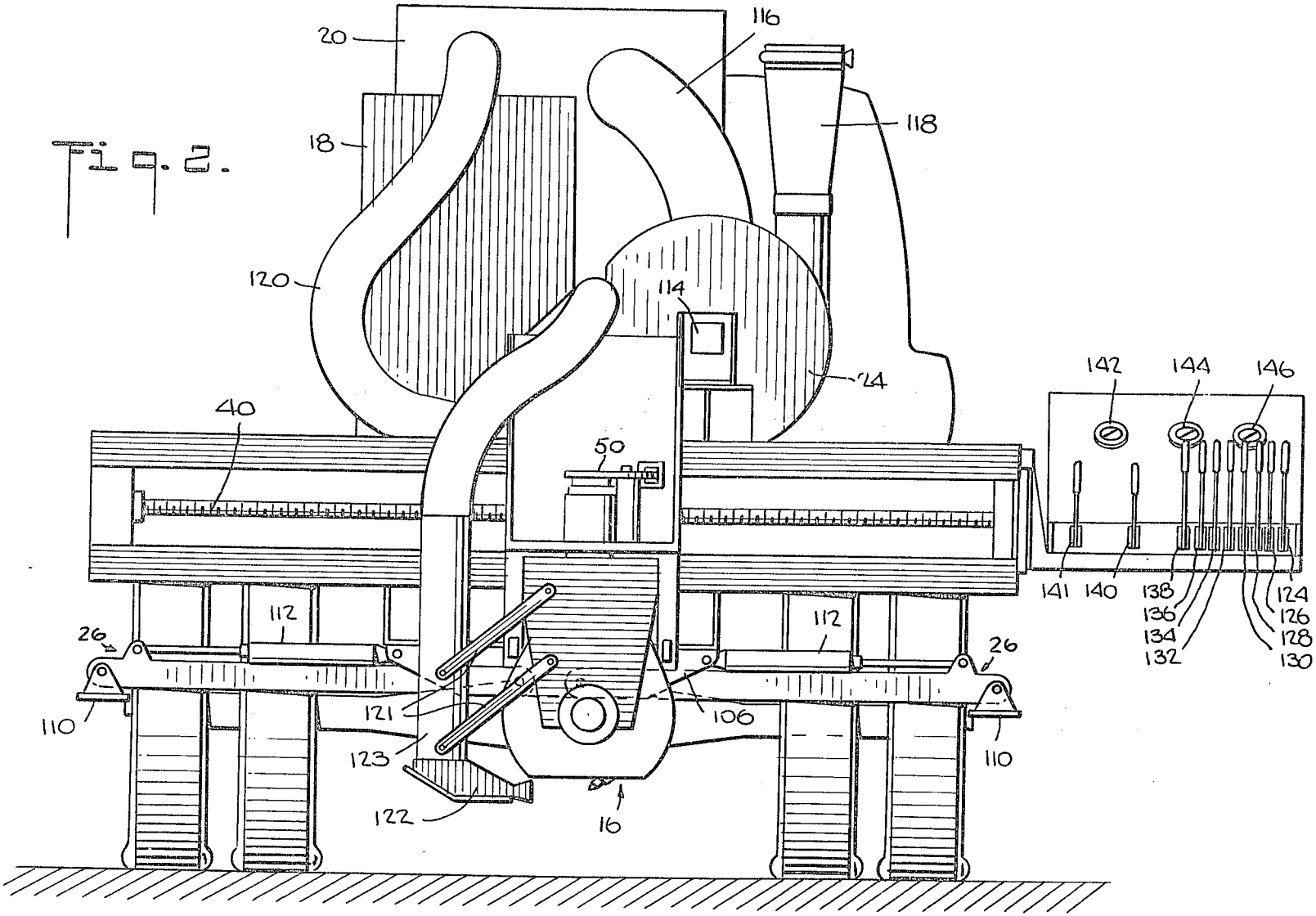
FIG. 2 is an end view of the same.
Figure 10:
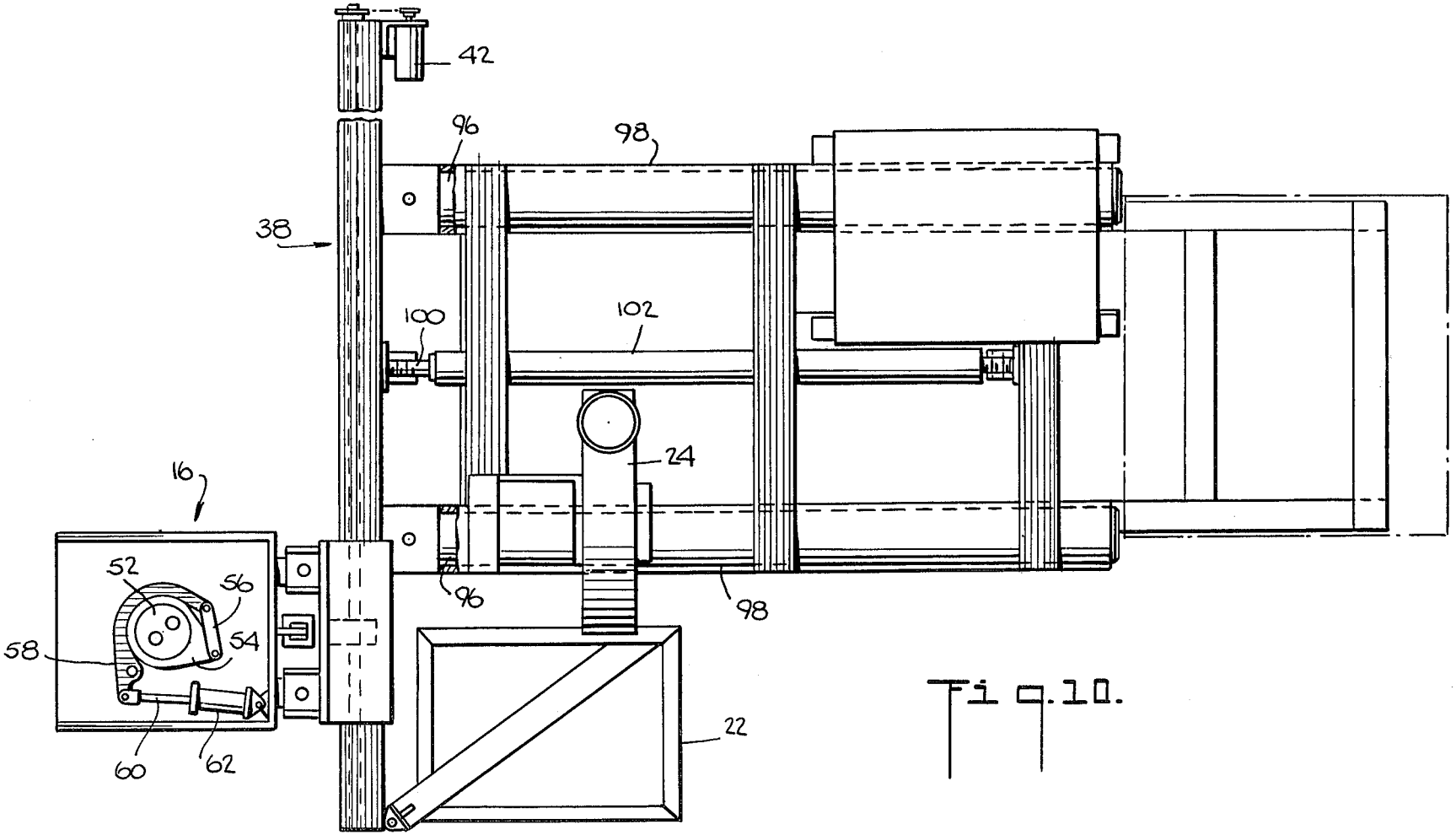
FIG. 10 is a plan view of the mounting arrangement of FIG. 7.

The control console 22 is pivotally affixed to the rail means assemblage 38, and when it is not being used, will be maintained in non-operative position as shown in FIG. 10, and when in operative position as shown in FIGS. 1, 2 and 4.

Levers to control operation of the various units are mounted on the console, which levers are identified as accessory device lever 124, bin tilt control lever 126, cutter drum rotation lever 128, with drum vertical movement lever 130, rail means longitudinal movement control lever 132, rail means lateral movement control lever 134, outrigger control levers 136 (up) and 138 (down), cutter rotation speed control 140, and a hammer control lever 141. The lever arrangement depicted could be rearranged, if desired, without departing from the functional aspects involved, however, the arrangement shown has proven practical in usage. Pressure gages are arranged on the console for drum inlet pressure 142, screw feed pressure 144 and blower motor pressure 146.

OPERATION OF PREFERRED EMBODIMENT

Upon arrival of the vehicle at scene of operation, the control console is swung into operative position (FIG. 2) and the outrigger controls are manipulated bringing the outrigger pads 110 in contact with the ground surface, to stabilize the vehicle during the road surface removal operation. Next, rotation of the drum is initiated and the drum unit 16 is lowered until a desired depth of cut on the road surface is achieved. The operator then manipulates the controls to produce a longitudinal cut as possible by boom operation, or a lateral cut by drive screw operation. The cutter drum unit 16, is normally positioned so that the cutting elements are rotated in the direction of drum movement, however, if desired, the operator may produce a skewed cut pattern, that is, wherein drum rotation is at 90° with drum travel pattern.

The machine of the invention may be designed to produce a 4 ft. by 8 ft. surface removal pattern (FIG. 13) without repositioning of the vehicle. It will be further seen that the cutter drum can be manipulated to cut at right angles to the initial cut made in the road surface, thus removing the feather-edge produced during the initial end cut. In such manner, repair material will be deposited in a recess or cavity wherein all peripheral edges are vertical, thus producing better road repair.

While various changes can be made in design proportions over those illustrated, a drum cutter diameter of 22", with cutter rotation speed of 1250 rpm, produced a 600 $in^3$/min. removal of concrete.

I claim:

1. A machine for cutting a road surface to a predetermined depth, said machine comprising a modular assemblage mountable upon the chassis of a motor vehicle of the truck type, said modular assemblage including a cutter drum unit having a cutter drum assemblage, first means to move the cutter drum unit along a vertical axis, second means to rotate the cutter drum unit 90° about the vertical axis, third means to move the cutter drum unit laterally relative to the chassis, fourth means to move the cutter drum unit longitudinally relative to the chassis, a control console having means arranged for operation of said first, second, third and fourth means either individually or in combination, said cutter drum assemblage having a pluraity of cutter arms each rotatable 360° in planes parallel with said cutter drum unit vertical axis, each of said cutter arms having a cutter bit at one end an enlarged portion at the opposite end arranged to have the center of percussion of the cutter arm coincide with the cutter bit and means to rotate the cutter drum assemblage whereby the cutter bits will successively impact upon the road surface.

2. A machine according to claim 1, wherein said first means includes a piston assemblage operatively connected to the cutter drum unit, said second means includes a cylinder and linkage assemblage operatively connected to the cutter drum unit, said third means includes a screw shaft operatively connected to the cutter drum unit, and said fourth means includes a cylinder and piston assemblage which is operatively connected to a horizontal rail means supporting said screw shaft.

3. A machine according to claim 1, wherein said modular assemblage has a debris pickup means including a nozzle and hose arrangement wherein a suction condition may be generated to pick up road surface cuttings for delivery to a bin mounted upon the chassis, said bin being tiltable for discharge of the debris therein when such discharge action is desired by the machine operator.

4. A machine according to claim 3, wherein said nozzle is positioned in close proximity to the road surface and adjacent the cutter drum assemblage to directly collect the debris being produced by cutter bit action.

* * * * *